United States Patent [19]

Wakabayashi

[11] 4,433,628

[45] Feb. 28, 1984

[54] APPARATUS FOR PREVENTING RUNAWAY OF CARRIERS IN POWER AND FREE CONVEYOR

[75] Inventor: Takao Wakabayashi, Shinsenri-Minamimachi, Japan

[73] Assignee: 501 Nakanishi Metals Works Co., Ltd., Osaka, Japan

[21] Appl. No.: 347,241

[22] Filed: Feb. 9, 1982

[51] Int. Cl.[3] ..... B61H 9/04; B61B 10/02; B66B 5/16

[52] U.S. Cl. ..... 104/172 S; 104/250; 187/73; 188/111

[58] Field of Search ..... 104/250, 249, 117.1, 104/172 S, 172 C, 172 B, 238, 239, 251, 257, 172 R; 188/111, 189, 180; 198/856; 187/38, 73, 77, 82; 105/148, 149

[56] References Cited

U.S. PATENT DOCUMENTS

| | | | |
|---|---|---|---|
| 931,078 | 8/1909 | Norton | 187/82 |
| 1,010,090 | 11/1911 | Szentivanyi | 187/82 |
| 3,149,715 | 9/1964 | Massimiani | 104/249 |
| 3,683,817 | 8/1972 | Macomber et al. | 104/172 S |

FOREIGN PATENT DOCUMENTS

| | | | |
|---|---|---|---|
| 47-46751 | 11/1972 | Japan . | |
| 53-33195 | 9/1978 | Japan . | |
| 213667 | of 1968 | U.S.S.R. | 198/856 |

*Primary Examiner*—Robert B. Reeves
*Assistant Examiner*—David F. Hubbuch
*Attorney, Agent, or Firm*—Armstrong, Nikaido, Marmelstein & Kubovcik

[57] ABSTRACT

In an apparatus for preventing runaway of carriers in a power-and-free conveyor, each of the carriers has a runaway preventing stopper rotatable about its center portion in a substantially vertical plane parallel with the direction of advance of the conveyor, and a restraining member engageable with one end of the stopper for usually preventing the other end thereof from turning forward. The stopper is biased always by weighted arm to turn the other end forward. Runaway preventing contact members are arranged at a spacing in each of rising and falling gradient sections of the conveyor along the path of movement of the stopper other end. When the carrier runs out of control in the falling gradient section, the stopper other end collides with one of the contact members and is thereby turned rearward into engagement with the restraining member against the weighted arm while bringing the one end of the stopper into engagement with another contact member to prevent the carrier from running away. In the event of runaway in the rising section, the other end of the stopper comes into engagement with one of the contact members with its one end in engagement with the restraining member to prevent the carrier from running out of control.

7 Claims, 8 Drawing Figures

APPARATUS FOR PREVENTING RUNAWAY OF CARRIERS IN POWER AND FREE CONVEYOR

BACKGROUND OF THE INVENTION

The present invention relates to an apparatus for preventing carriers from running out of control in a power-and-free conveyor.

Throughout the specification and the appended claims, the terms "front" or "forward" and "rear" or "rearward" are based on the direction of advance of the conveyor. Thus the term "front" or "forward" refers to the direction in which the conveyor advances, and the term "rear" or "rearward" to the opposite direction. The terms "right" and "left" are used when a person faces the forward direction.

Generally power-and-free conveyors have rising gradient sections and falling gradient sections. When a carrier is running into such a gradient section, it is likely that the drive chain will break or the free trolley will disengage from the power trolley. In such an event, the carrier will run out of control toward the descending direction along the gradient section. Accordingly there is the need to provide an apparatus for preventing runaway of carriers.

For the prevention of runaway in falling gradient sections of conveyors, an apparatus is known which comprises a runaway preventing member in an approximately T-shaped form and supported at its center portion by a horizontal pivot at the top of the power rail. The preventing member has opposite arms one of which serves as a trolley striking portion and the other as a trolley engaging portion. Another apparatus is known for use in rising gradient conveyor sections which comprises a plurality of moving members arranged along the direction of advance of the conveyor at a required spacing and movable along the rising gradient section, a retraction preventing stopper provided on each of the moving members for permitting only the advance of the trolley, means for coupling the moving member to an operative portion of a detector disposed at a required location, and a spring for biasing the moving member upward along the gradient section.

However, the former apparatus, which is designed for use in falling gradient sections, is not usable for rising gradient sections. Furthermore, depending on the location of the runaway preventing member, there is the likelihood that the apparatus will be unable to stop the foremost of runaway carriers. This must be eliminated by the use of a large number of runaway preventing members, which render the apparatus costly. The apparatus of the latter type is adapted for use in rising gradient sections and is not usable for falling gradient sections. The apparatus has the drawback that it is complex in construction, requires a large number of moving members and is therefore costly.

SUMMARY OF THE INVENTION

The main object of the present invention is to provide an inexpensive apparatus for reliably preventing runaway of carriers in rising gradient sections and also in falling gradient sections.

To fulfill the above object, this invention provides an apparatus for preventing runaway of carriers in a power-and-free conveyor including a power rail having a drive chain, a free rail disposed below the power rail at a predetermined distance therefrom, the carriers movably supported by the free rail and having engagement portions, and a plurality of pusher dogs attached to the drive chain and engageable with the engagement portions of the carriers. The conveyor has a rising gradient section and a falling gradient section. The runaway preventing apparatus comprises a runaway preventing stopper provided on each of the carriers and rotatable about a longitudinal midportion of the stopper in an approximately vertical plane in parallel with the direction of advance of the conveyor, a restraining member engageable with one end of the stopper below the center of the rotation for usually preventing the other end of the stopper from turning forward to hold the stopper in an approximately vertical position, a plurality of runaway preventing contact members arranged in each of the rising and falling gradient sections in the path of movement of the other end of the stopper at a specified spacing in the direction of advance to come into contact with the other end, and biasing means biasing the stopper at all times to forwardly turn the other end of the stopper and having a biasing force which is greater than the force acting to rearwardly turn the other end when the other end strikes against the runaway preventing contact member at a usual speed of advance of the carrier and which is smaller than the force acting to rearwardly turn the other end of the stopper upon the other end striking against the contact member when the carrier runs away in the falling gradient section.

When the carrier runs out of control in the falling gradient section, the above-mentioned other end of the stopper collides with one of the runaway preventing contact members and is thereby turned rearward into engagement with the restraining member while bringing the above-mentioned one end of the stopper into engagement with another contact member at the same time, whereby the carrier is prevented from running away. When the carrier runs out of control in the rising gradient section, the other end of the stopper comes into engagement with one of the contact members with its one end in engagement with the restraining member to prevent the carrier from running away. In this way, the carrier can be reliably prevented from running out of control in the falling gradient section and also in the rising gradient section. The apparatus is simple in construction and therefore inexpensive.

The invention will be described below in greater detail with reference to the accompanying drawings.

DESCRIPTION OF THE PREFERRED EMBODIMENT

Figure 1:
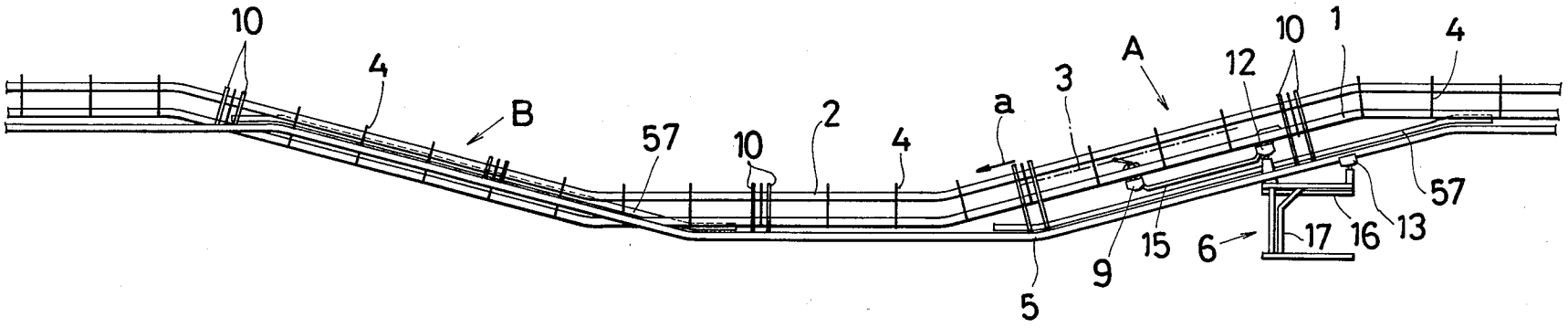
FIG. 1 is a side elevation showing and power-and-free conveyor equipped with an apparatus of the invention for preventing runaway of carriers.
Figure 2:
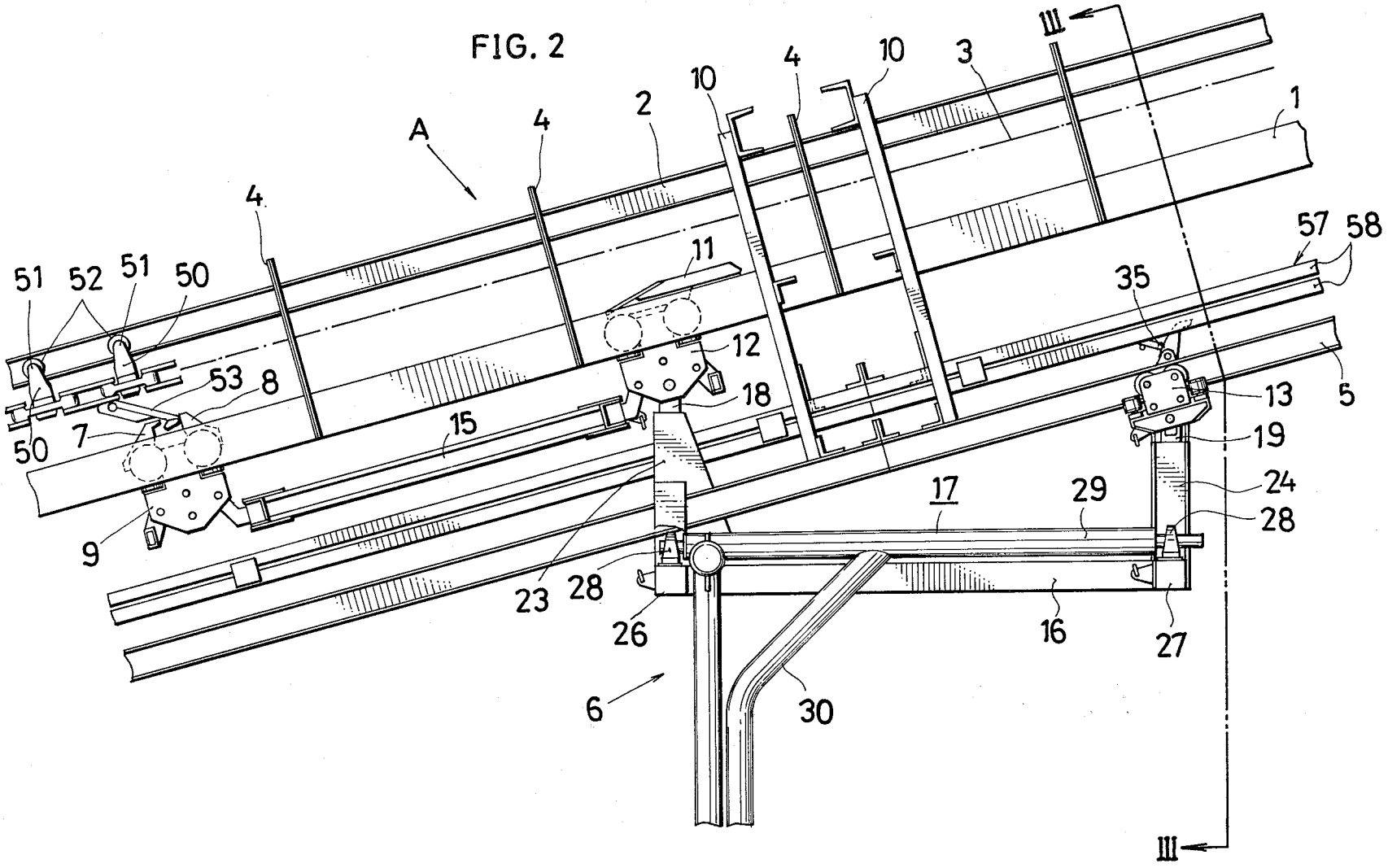
FIG. 2 is an enlarged side elevation showing a falling gradient section of the conveyor.
Figure 3:
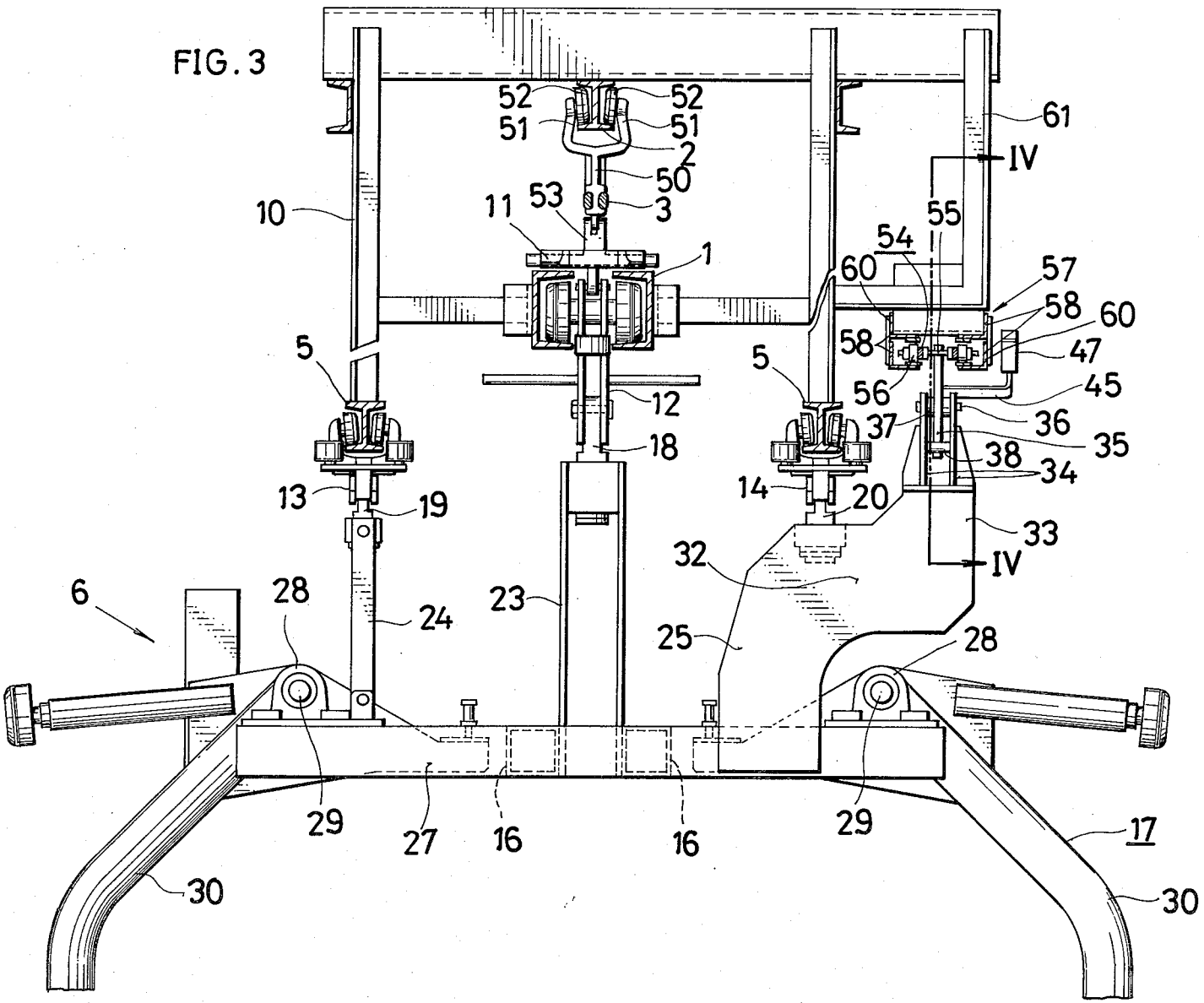
FIG. 3 is an enlarged view in section taken along the line III—III in FIG. 2.
Figure 4:
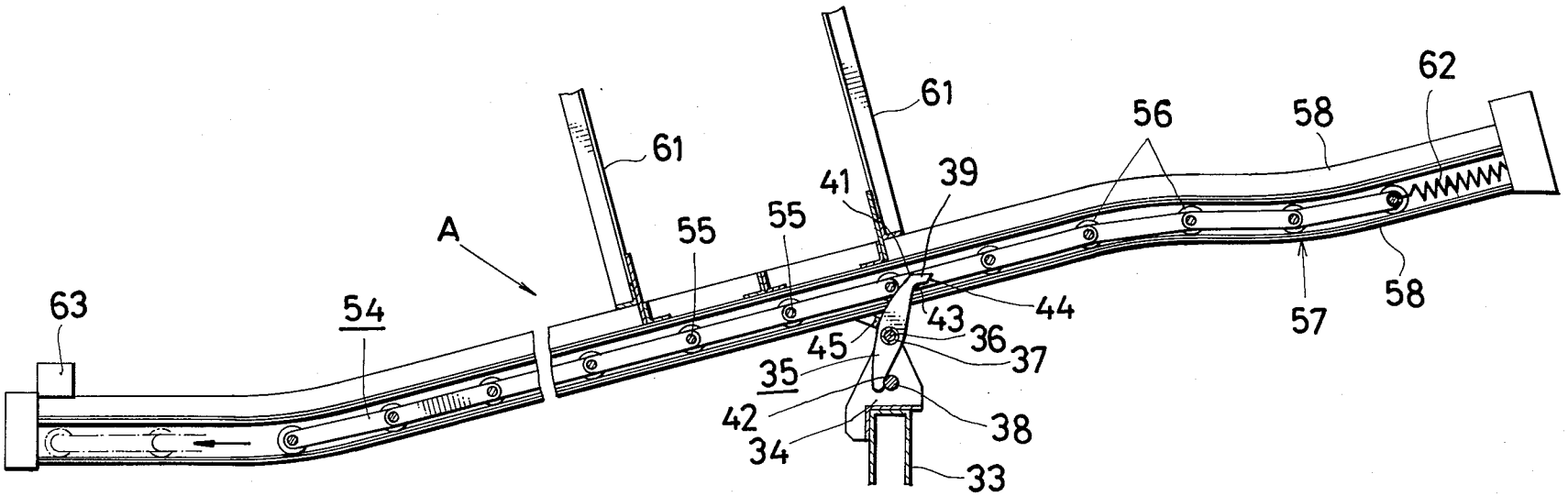
FIG. 4 is a view in section taken along the line IV—IV in FIG. 3.
Figure 5:
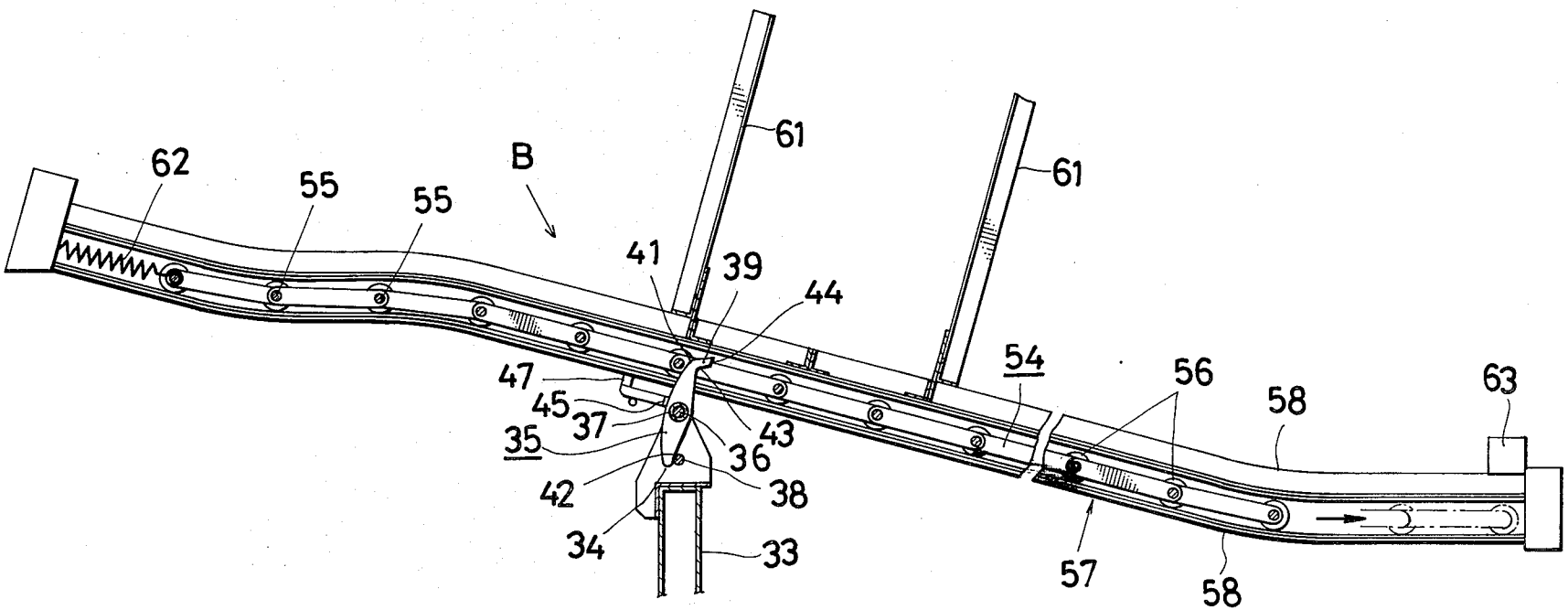
FIG. 5 is a sectional view showing a rising gradient section in corresponding relation to FIG. 4.

With reference to FIGS. 1 to 8 showing an embodiment of the invention, a power-and-free conveyor includes a main free rail 1, a power rail 2 disposed above the rail 1 at a specified distance therefrom and a drive chain 3 extending below the power rail 2. The rail 2 and the chain 3 are endless. The main free rail 1 comprises a pair of steel channel members spaced apart at a specified distance with their grooves opposed to each other. An I bar is used as the power rail 2. The main free rail 1 and the power rail 2 are connected together by frames 4 arranged at a predetermined spacing.

Auxiliary free rails 5 are arranged on the opposite sides of the main free rail 1. The auxiliary free rails 5 are at a slightly lower level than the main free rail 1 in a horizontal section of the conveyor, at a still lower level relative to the rail 1 in a falling gradient section A, and at a slightly higher level than the rail 1 in a rising gradient section B, so that an article supported by the hanger 17 to be described later will be transported in a horizontal position at all times. The rails 5 are connected to the rails 1, 2 by frames 10. Carriers 6 are movably supported by the free rails 1, 5. The carrier 6 comprises a front free trolley 9 having a pair of front and rear tilting dogs 7, 8, an intermediate free trolley 12 having a rearwardly projecting cam 11 for pushing up a propelling member, a pair of right and left rear free trolleys 14, 13, a front connecting bar 15 connecting the front free trolley 9 to the intermediate free trolley 12, rear connecting bars 16 connecting the intermediate free trolley 12 to the rear free trolleys 13, 14, and the aforementioned hanger 17 attached to the rear connecting bars 16. The front free trolley 9 and the intermediate free trolley 12 are movably supported by the main free trolley 1. The rear free trolleys 13, 14 are movably supported by the auxiliary free trolleys individually. Downwardly projecting suspending members 18, 19, 20 are pivoted to the lower ends of the intermediate free trolley 12 and the rear free trolleys 13, 14 respectively and are movable forward or rearward. The rear connecting bars 16, each in the form of a steel member of square cross section, are spaced apart by a specified distance transversely of the front-to-rear direction. An upwardly projecting connecting member 23 is held at its lower end between the front ends of the bars 16. Transversely extending horizontal members 26, 27 are attached to the front end faces and the rear end faces of the rear connecting bars 16, respectively. Connecting members 25, 24 extend upward from right and left end portions of the rear transverse member 27, respectively. The lower ends of the suspending members 18, 19, 20 are attached to the upper ends of the connecting members 23, 24, 25, respectively. The hanger 17 comprises rods 29 rotatably supported by and extending between brackets 28 on the upper side of the front and rear transverse members 26, 27, and a pair of opposite article support members 30 extending downward from the rods 29 and movable toward or away from each other. The brackets 28 are positioned some distance outwardly of the rear connecting members 24, 25.

An arm 32 extends rightward from the upper end of the right connecting member 25. An upward projection 33 is integral with a right top portion of the arm 32. A pair of brackets 34 opposed to each other in the transverse direction at a specified spacing are mounted on the top of the projection 33. A runaway preventing stopper 35 in the form of an elongated plate is supported at a longitudinal midportion on a horizontal pivot 36 extending between and attached to the brackets 34. The stopper 35 is rotatable about the pivot 36 in an approximately vertical plane in parallel with the direction of advance of the conveyor. The stopper 35 is formed at its midportion with a boss portion 37 through which the pivot 36 extends. Below the horizontal pivot 36, a restraining pin 38 extends between and is fixed to the bracekts 34. The pin 38 is engageable with one end of the stopper 35 and usually prevents the other end of the stopper 35 from turning forward to hold the stopper 35 in an approximately vertical position. The stopper 35 will be described below further based on its usual vertical position stated above. When seen from one side, the stopper 35 is tapered from its center portion toward its upper and lower ends and has a smoothly curved front edge to project forward at the center portion. A rearward projection 39 integral with the upper end defines a bent recessed portion at its lower part. The projection 39 has a rear edge slanting forwardly downward. The stopper 35 has a front edge upper end portion 41 which is adapted to strike against the runaway preventing pin 55 to be described later. The lower end of the rear edge of the stopper 35 serves as an engaging portion 42 which is usually in engagement with the restraining pin 38 and which comes into engagement with the pin 55 upon the stopper upper end turning rearward when the carrier 6 runs out of control in the falling gradient section A. The bent recessed portion, namely engaging recessed portion 43, engages the restraining pin 38 when the stopper upper end turns rearward. The slanting rear edge of the rearward projection 39 serves as a contact portion 44 which comes into engagement with the pin 55 when the carrier 6 runs out of control in the rising gradient section B. A rightwardly projecting arm member 45 is attached to a front edge portion of the stopper 35 a small distance above the horizontal pivot 36. The forward end of the arm member 45 extends forwardly upward and is provided with a weight 47 biasing the stopper 35 at all times to turn its upper end forward. The biasing force of the weight 47 acting to forwardly turn the upper end of the stopper 35 is greater than the force acting to rearwardly turn the stopper upper end when the striking portion 41 of the stopper 35 strikes against the runaway preventing pin 55 at the usual running speed of the carrier 6 but is smaller than the force acting to rearwardly turn the stopper upper end upon the striking portion 41 striking against the pin 55 when the carrier 6 runs out of control in the falling gradient section A. In the usual state, the stopper 35 is held in an approximately vertical position against turning forward by the engagement of the engaging portion 42 with the restraining pin 38.

Power trolleys 50 are movably supported by the power rail 2. The trolley 50 comprises a pair of opposed upright arms 51 and a pair of rollers 52 mounted on their upper ends. The rollers 52 are rollable on the lower horizontal flanges of the power rail 2 to move the trolley along the rail 2. The drive chain 3 disposed below the power rail 2 is driven in the direction of arrow a in FIG. 1 at all times by an unillustrated motor and transmitting means. The lower ends of the upright arms 51 of the power trolley 50 are connected to the chain 3. The power trolleys 50 are arranged in pairs at a given spacing along the chain. A downwardly projecting bracket is fixed to the link plate of the chain 3 interconnecting the trolleys 50 of each pair. A propelling member 53 attached to the bracket is pivotally movable upward or downward and is suspended therefrom to project rearwardly downward under gravity. The propelling member 53 has a hooked lower end having a horizontal portion. In the horizontal section and the rising gradient section B of the conveyor, the propelling member 53 engages the front tilting dog 7 of the front free trolley 9 to move the carrier 6 with the drive chain 3 in the direction of arrow a. In the falling gradient section A, the propelling member 53 engages the rear tilting dog 8 of the front free trolley 9 to cause the carrier 6 to run in the direction of arrow a at the same speed as the power trolleys 50.

A chain 54 extends along each of the falling and rising gradient sections A, B of the conveyor and is positioned on the right side of and slightly above the right auxiliary free rail 5. The connecting pins of the chain 54 are arranged on the path of movement of the stopper striking portion 41 during the travel of the carrier 6. These connecting pins serve as pins 55 for preventing runaway of the carrier 6. The chain 54 is forwardly and rearwardly movably supported on a chain holding rail 57 extending along the gradient section by rollers 56 provided outside the link plates of the chain. The chain holding rail 57 comprises opposed half segments 60 each composed of upper and lower two angle bars 58 which are connected together by a plate to provide a channel. The half segments are spaced apart by a specified spacing with their channel openings opposed to each other. At a level slightly above the auxiliary free rail 5, the rail 57 is attached to the projecting ends of brackets 6 on the lower side thereof. The bracket 61 extends rightward from the connecting frame 10. The rollers 56 on the chain 54 are supported on the horizontal flanges of the lower angle bars 58. Attached to the slanting upper end of the chain 54 is a tension spring 62 which extends from the chain end obliquely upward along the gradient. The biasing force at the falling gradient section A is greater than the force of the chain 54 acting to move along the rail 57 plus the force resulting from the contact of the striking portion 41 of the stopper 35 with the pin 55 during the usual travel of the carrier 6 but is smaller than the force of the chain 54 acting to move along the rail 57 plus the forward component along the section A of the weight of the carrier 6. The biasing force of the tension spring 62 in the rising gradient section B is made approximately equal to that of the spring 62 in the section A. Accordingly when a runaway carrier 6 is stopped in the section A or B, the chain 54 moves toward the descending direction along the rail 57. Each of the stations A, B is provided with a detector 63 at a location away from the lower end of the chain 54 toward the descending direction of the station for detecting the lower end of the chain 54 in its lowered position. For example, a limit switch, photoelectric switch or the like is useful as the detector 63. When the end of the chain 54 is detected by the detector 63, the detecting signal turns on an alarm and/or brings the drive chain 3 to a halt.

Figure 6:
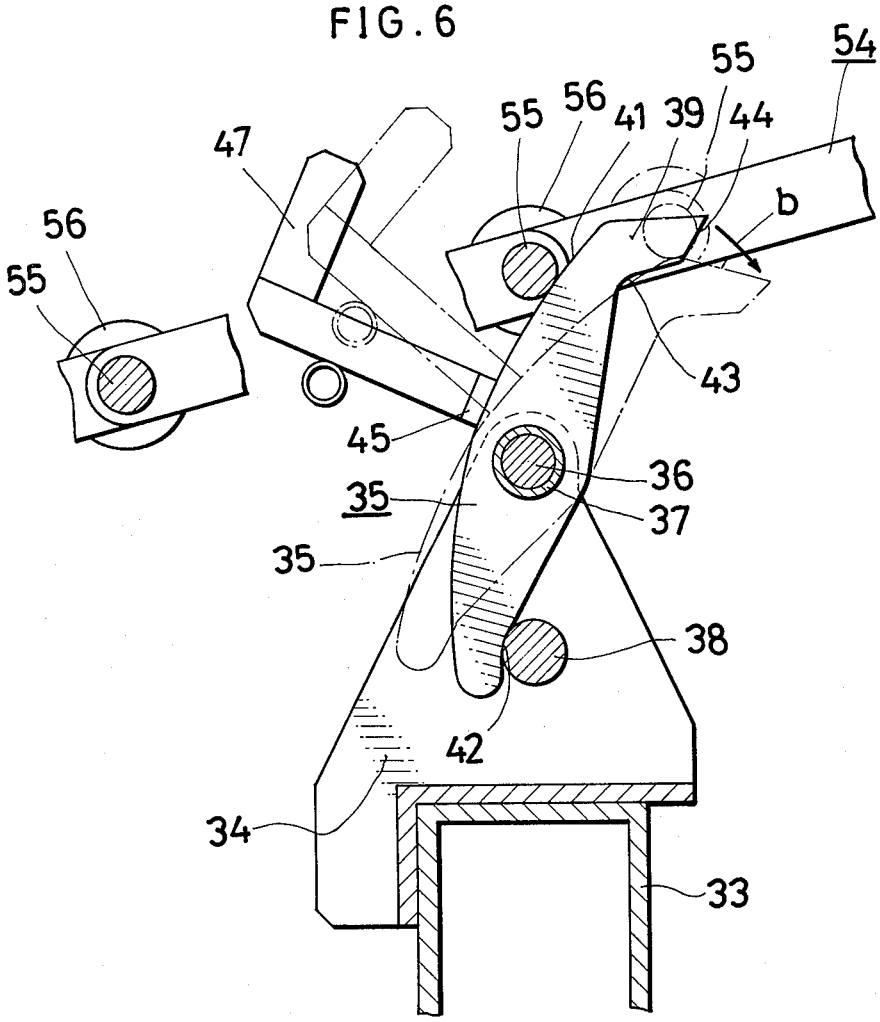
FIG. 6 shows the movement of a runaway preventing stopper while the carrier is running in the usual manner.
Figure 7:
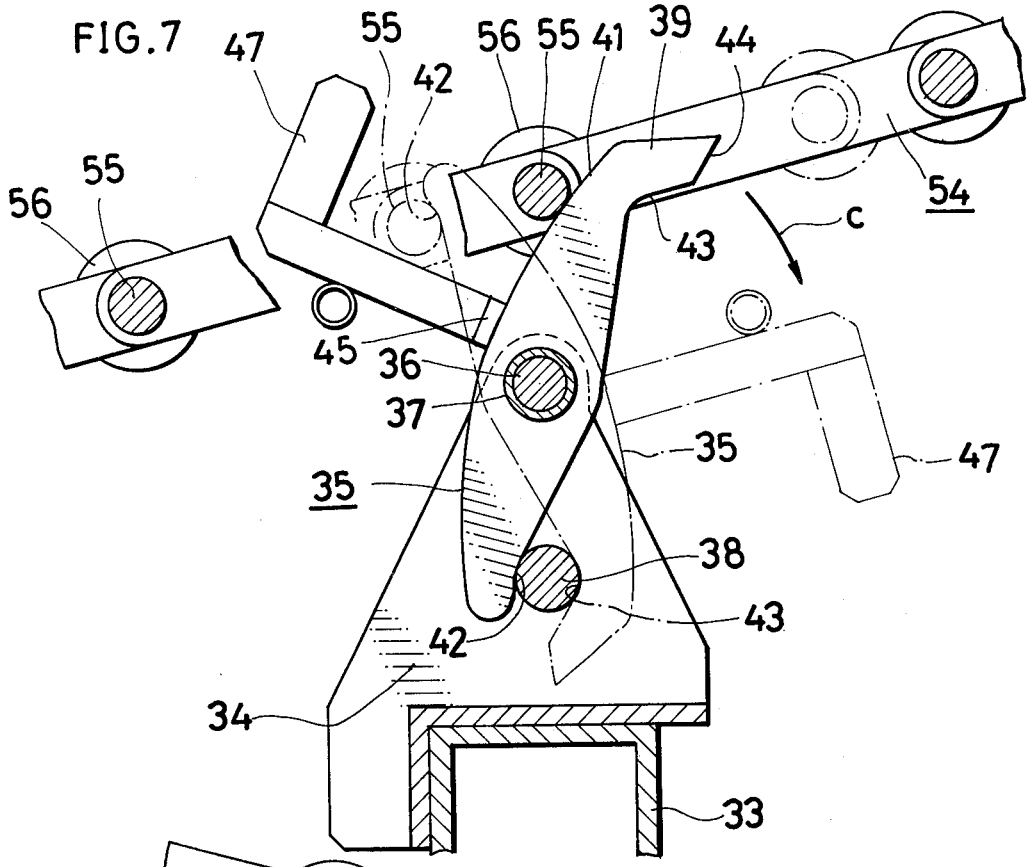
FIG. 7 shows the movement of the stopper when the carrier runs out of control in the falling gradient section.
Figure 8:
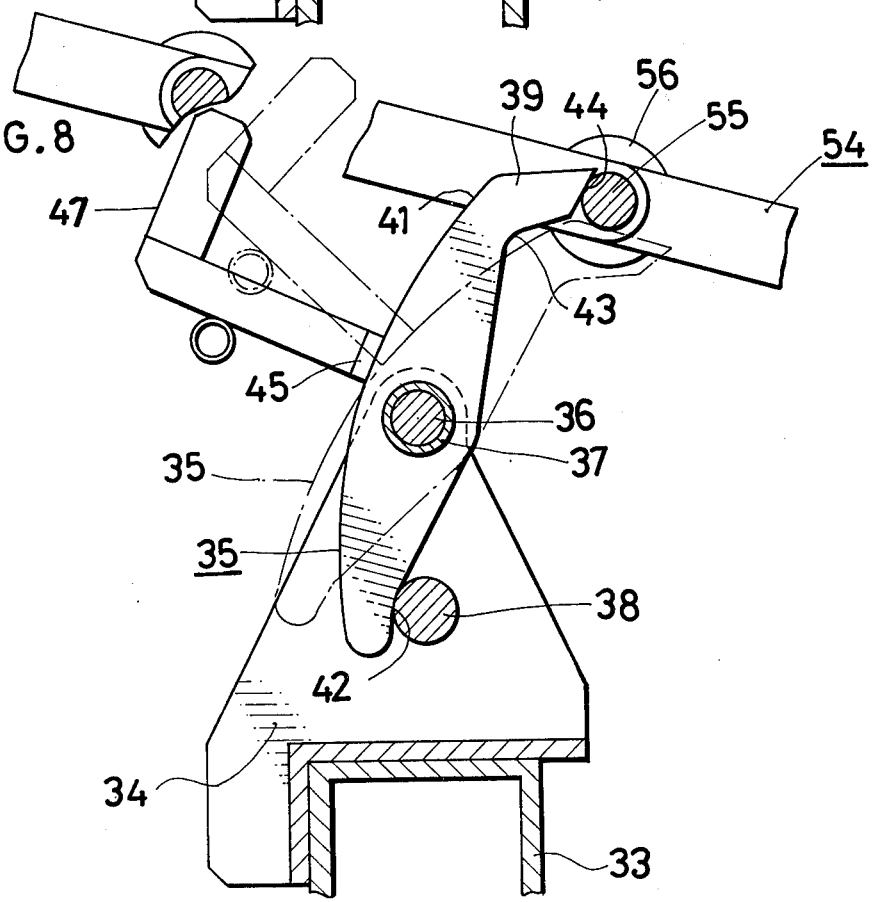
FIG. 8 shows the movement of the stopper when the carrier runs out of control in the rising gradient section.

During the travel of the carrier 6 through the falling gradient section A in the usual mode, the striking portion 41 of the stopper 35 lightly strikes against one of the runaway preventing pins 55 as shown in FIG. 6, whereby the upper end of the stopper 35 is turned rearward as indicated by an arrow b in FIG. 6 to pass under the pin 55 as indicated in broken lines in the same drawing, permitting the stopper 35 to advance with the carrier 6. Upon the passage of the stopper upper end under the pin 55, the weight 47 turns the upper end forward, bringing the stopper 35 into the initial position. With the stopper repeating this pivotal motion, the carrier 6 passes through the section A. In the rising gradient section B, the stopper 35 repeatedly performs the same to-and-fro pivotal motion as in the section A, permitting the carrier 6 to pass through the section B (see broken lines in FIG. 8).

In the event of an accident occurring in the falling gradient section A as when the driven chain 3 breaks or a propelling member 53 disengages from the rear tilting dog 8, the carrier 6 runs out of control along the free rails 1, 5 in the same direction as the usual direction of transport. In this case, the striking portion 41 of the stopper 35 collides with one of the runaway preventing pins 55. The force resulting from the collision and acting to turn the upper end of the stopper 35 rearward is greater than the forward biasing force of the weight 47, consequently turning the stopper upper end rearward. Upon passing a location vertically above the horizontal pivot 36, the weight 47 coacts to turn the upper end rearward. As a result, the stopper 35 turns through about 180° in the direction of arrow c in FIG. 7, bringing the engaging recessed portion 43 of the stopper 35 into engagement with the restraining pin 38 and permitting the engaging portion 42 thereof to position above another pin 55, with the weight 47 positioned to the rear of the horizontal pivot 36 (see the broken-line position in FIG. 7). The engaging portion 42 engages with the pin 55, while the stopper 35 is prevented from further turning by the restraining pin 38, with the result that the carrier 6 is prevented from running away. The chain 54 now moves toward the descending direction along the rail 57 against the force of the spring 62. The lower end of the chain is detected by the detector 63, and the detecting signal turns on the alarm and/or stops the drive chain 3.

When an accident occurs in the rising gradient section B as when the drive chain 3 breaks or a propelling member 53 disengages from the front tilting dog 7, the carrier 6 runs out of control in a direction opposite to the usual direction of transport, whereupon the contact portion 44 of the rearward projection 39 of the stopper 35 comes into contact with one of the runaway preventing pins 55, with the stopper 35 prevented from turning by the restraining pin 38 to prevent the carrier 6 from running away. As in the section A, the chain 54 now moves toward the descending direction, and the lower end of the chain is detected by the detector 63. The detecting signal turns on the alarm and/or stops the drive chain 3.

The present invention may be embodied differently without departing from the spirit and basic features of the invention. Accordingly the embodiment herein disclosed is given for illustrative purposes only and is in no way limitative. It is to be understood that the scope of the invention is defined by the appended claims rather than by the specification and that various alterations and modifications within the definition and scope of the claims are included in the claims.

What is claimed is:

1. An apparatus for preventing runaway of carriers in a power-and-free conveyor including a power rail having a drive chain, a free rail disposed below the power rail at a predetermined distance therefrom, the carriers movably supported by the free rail and having engagement portions, and a plurality of pusher dogs attached to the drive chain and engageable with the engagement portions of the carriers, the conveyor having a rising gradient section and a falling gradient section, the runaway preventing apparatus comprising a runaway preventing stopper provided on each of the carriers and rotatable about a longitudinal midportion of the stopper in an approximately vertical plane in parallel with the direction of advance of the conveyor, a restraining member engageable with one end of the stopper below the center of the rotation for usually preventing the other end of the stopper from turning forward to hold the stopper in an approximately vertical position, a plurality of runaway preventing contact members arranged in each of the rising and falling gradient sections in the path of movement of the other end of the stopper at a specified spacing in the direction of advance to come into contact with the other end, and biasing means biasing the stopper at all times to forwardly turn the other end of the stopper and having a biasing force which is greater than the force acting to rearwardly turn the other end when the other end strikes against the runaway preventing contact member at a usual speed of advance of the carrier and which is smaller than the force acting to rearwardly turn the other end of the stopper upon the other end striking against the contact member when the carrier runs away in the falling gradient section.

2. An apparatus as defined in claim 1 wherein the runaway preventing contact members are the connecting pins of a chain disposed in each of the gradient sections so as to move at least in the descending direction and biased toward the ascending direction at all times.

3. An apparatus as defined in claim 2 which includes a detector for detecting the lower end of the chain in its lowered position when the chain moves in the descending direction along each of the gradient sections.

4. An apparatus as defined in any one of claims 1 to 3 wherein the stopper is in the form of a plate positioned in the approximately vertical plane and tapered from the center of the rotation toward its opposite ends, the other end having a striking portion engageable with the contact member, a contact portion engageable with the contact member when the carrier runs away in the rising gradient section and an engaging recessed portion engageable with the restraining member when the other end of the stopper turns rearward, said one end of the stopper having an engaging portion usually engageable with the restraining member and engageable with the contact member when the other end of stopper turns rearward.

5. An apparatus as defined in claim 4 wherein the restraining member is a pin having an axis extending transversely of the direction of advance.

6. An apparatus as defined in claim 4 wherein the biasing means is a weight forwardly projecting from a portion of the stopper which portion is away from the center of the rotation toward the other end.

7. A power-and-free conveyor comprising a power rail having a drive chain, a free rail disposed below the power rail at a predetermined distance therefrom, carriers movably supported by the free rail and having engagement portions, and a plurality of pusher dogs attached to the drive chain and engageable with the engagement portions of the carriers, the conveyor having a rising gradient section and a falling gradient section, each of the gradient sections being provided with a chain movable at least in the descending direction along the section and biased toward the ascending direction along the section at all times and a detector for detecting the lower end of the chain in its lowered position when the chain moves in the descending direction along the section.

* * * * *